United States Patent [19]

Chipman et al.

[11] 4,410,398

[45] Oct. 18, 1983

[54] METHOD AND APPARATUS FOR MONITORING THE CUTTING OF COKE IN A PETROLEUM PROCESS

[75] Inventors: Arthur H. T. Chipman, Long Beach; Ernest M. Bony, Palos Verdes Estates, both of Calif.

[73] Assignee: Shell Oil Company, Houston, Tex.

[21] Appl. No.: 350,948

[22] Filed: Feb. 22, 1982

[51] Int. Cl.[3] ..... C10B 33/00; C10B 41/04; C10B 43/08; C10B 55/00

[52] U.S. Cl. ..... 201/1; 201/2; 202/241; 202/262

[58] Field of Search ..... 201/1, 2; 202/241, 262, 202/270; 134/18, 39, 113

[56] References Cited

U.S. PATENT DOCUMENTS

| | | | |
|---|---|---|---|
| 3,836,434 | 9/1974 | Novy | 201/2 |
| 3,892,633 | 7/1975 | Oleszko et al. | 202/241 |

FOREIGN PATENT DOCUMENTS

| | | | |
|---|---|---|---|
| 56-38129 | 4/1981 | Japan | 201/2 |
| WO80/00849 | 5/1980 | PCT Int'l Appl. | 201/1 |
| 611921 | 6/1978 | U.S.S.R. | 202/262 |

*Primary Examiner*—Bradley Garris

[57] ABSTRACT

A method and apparatus for assisting an operator in a coke cutting operation wherein both a graphic and audio display of the operation are provided. The vibration of the coke drum is measured and after filtering, is recorded on a chart recorder and its amplitude converted to a related audio signal.

3 Claims, 1 Drawing Figure

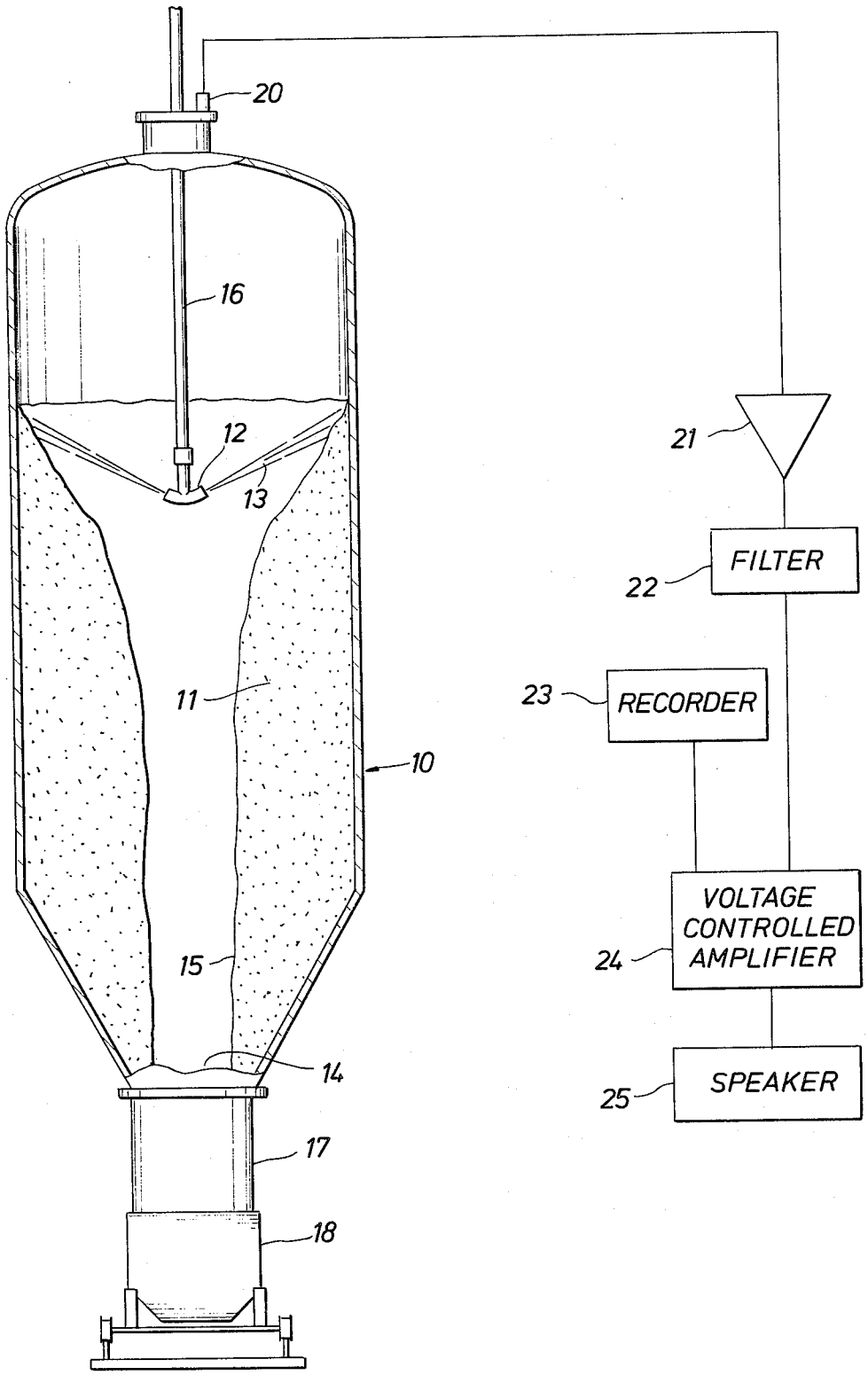
20
16
12
13
21
FILTER
22
23
RECORDER
11
10
VOLTAGE CONTROLLED AMPLIFIER
24
15
14
25
SPEAKER
17
18

METHOD AND APPARATUS FOR MONITORING THE CUTTING OF COKE IN A PETROLEUM PROCESS

BACKGROUND OF THE INVENTION

The present invention relates to a method and apparatus for monitoring the cutting of coke in a coke drum of petroleum refining process. In the refining of petroleum, the residual hydrocarbons that remain after lighter hydrocarbons have been removed to produce other products such as gasoline or diesel oils, is converted to coke. The residual hydrocarbons are converted to coke by heating them in the absence of air and allowing them to cool to form coke. Normally, the heating is done externally to a coke drum and the heated mixture discharged into the drum where it cools and solidifies to form coke. The coke drums are normally vertical, cylindrical drums and after they have been filled solid with coke, the heated residual is shifted to a second drum and the coke removed from the first drum.

The coke is removed from the drum by an operation normally referred to as coke cutting. The normal procedure in coke cutting is to first bore or drill a vertical hole through the coke in the drum and then enlarge the opening by reaming. Both the drilling and reaming are accomplished by utilizing a hydraulic jet which discharges in a downward direction. After the central opening has been enlarged to a diameter sufficient to permit all of the lumps of coke subsequently cut from the drum to fall through the bottom discharge, the boring and reaming operation is suspended. The nozzles on the coke cutting head are then charged to nozzles which are directed in a more horizontal direction. The head is then moved to the top of the drum and periodic slices of the coke are cut. It is normally preferable to cut the coke utilizing nozzles which are directed in a slight upward direction since this produces an inclined surface on the coke shelf that permits the water to drain from the coke and allows the large lumps of coke to fall downward through the bottom of the drum. At the bottom of the drum the coke is crushed to the desired fineness and conveyed to a location where it can be dried prior to further use.

During the coke cutting operation it is desirable to maintain the horizontal jets at a fixed position while rotating until the jets have completely cut through the coke and strike the walls of the coke drum. In the past, reliance has been placed on the operator's skill to determine when the jets are striking the wall of the drum. The operators normally relied upon their hearing and experience to determine when the jets were striking the wall of the drum. It is obvious that if the jets do not strike the wall of the drum, all of the coke will not be removed from the drum while if the jets remain in contact with the walls of the drum for any time, the coke cutting operation will be inefficient and require a longer time than is necessary.

SUMMARY OF THE INVENTION

The present invention solves the above problem by monitoring the coke cutting operation to provide the operator with both a visual and audible indication of when the jets are striking the walls of the coke drum. In particular, it has been discovered that the water jets striking the wall of the coke drum produce vibrations which can be either measured directly as by means of accelerometers or indirectly by means of microphones which pick up the sound produced by the vibrating walls. After the vibration of the coke drums has been detected, it is amplified and filtered to preserve one desirable frequency. Excellent results have been obtained by preserving a frequency of 1000 to 2000 hertz. The signal is then rectified and recorded on a conventional chart recorder which displays the amplitude of the signal while the rectified signal is also used to control a voltage-controlled amplifier. The voltage controlled amplifier produces a signal whose volume varies with the amplitude of the voltage representing the magnitude of the drum vibrations.

As explained above, the amplitude of the vibrations increase dramatically when the water jets strike the wall of the drum as compared to striking coke during the cutting process. Thus the audible display and graphic record can be used by the operator to control the lowering of the cutting jets in the coke drum.

A further advantage of the present invention is the ability to remotely locate the operator (person) from the coke drum. In the past where the operator listened for the change in the amplitude or magnitude of the sound produced by the drum vibrations, it was necessary for the operator to be physically in the vicinity of the drum. This eliminated the possibility of placing the operator in a sheltered location since it was necessary that he be exposed to the drum vibration or noise. With the present monitoring system, there is no necessity that the operator to be exposed to the drum vibrations or noise and he can be relocated in a remote location provided the controls for the lowering of the cutting head and rotating it are available to him at the remote location.

BRIEF DESCRIPTION OF THE DRAWING

The present invention will be more easily understood from the following detailed description of a preferred embodiment when taken in conjunction with the attached drawing showing a coke drum with the monitoring system of the present invention in block diagram form.

DESCRIPTION OF A PREFERRED EMBODIMENT

Referring to the attached drawing there is shown a coke drum 10 having coke 11 deposited therein. A center opening 15 has already been drilled and reamed in the center of the coke with the center opening 15 being enlarged to substantially the same diameter as the outlet 14 of the coke drum. As explained above, the center opening is normally formed by first drilling a small hole using a hydraulic or water jet and then enlarging the hole by means of a reamer or similar type of hydraulic jet. Positioned in the top of the drum, is a set of diametrically opposed nozzles 12 which produce water jet streams 13 which impinge upon the coke and cut or remove the coke from the drum. The nozzles, in turn, are suspended in the drum by means of a tubular member 16 which, in addition to supporting the nozzles, also supplies the pressurized water to the nozzles. Not shown in the attached drawing are means for raising and lowering the nozzles in the coke drum as well as rotating the nozzles within the drum. This type of coke cutting equipment is, of course, well known to those skilled in the art. Coke cut by the jets from the drum passes through a chute 17 and is discharged into a crusher 18. Various methods are utilized for transporting the coke from the coke drum to a storage location where the water can drain from the coke and the coke dried. For example, as an alternative, a hopper car could be used in place of a slurry pipeline for transporting the coke to a storage location.

Mounted on top of the drum is a motion sensing device 20 which may, for example, be an accelerometer. Instead of the accelerometer, one could also use a microphone suspended along the outside of the drum which would sense the acoustic waves produced by the vibration of the drum wall. Other types of devices can also be used for sensing the drum vibration. As explained, the amplitude of the drum vibrations increases materially when the water jets 13 strike the walls of the drum instead of the coke.

The device used for sensing the drum vibrations should convert the vibrations to a related electrical signal whose frequency is related to the frequency of the vibrations and whose amplitude is related to the magnitude of the vibrations. This signal is amplified by an amplifier 21 and supplied to a filter 22 that rejects all frequencies except those that best represent the vibration of the drum. It has been found that if the filter removes all frequencies except for the 1000 to 2000 hertz range, satisfactory results are obtained. Also, the range of 1000 to 2000 hertz provides a signal whose amplitude is more easily detected by the human ear than a higher frequency signal. The filtered and amplified signal is supplied to a conventional recorder 23. This signal is recorded by the recorder in the form of a chart record whose longitudinal direction is related to time while the vertical dimension is related to time while the vertical dimension is related to the amplitude. Thus, the signal from the amplifier 24 varies in amplitude in direct relationship to the variation in the amplitude of vibration of the drum. This signal can be used to power a speaker 25 which will provide an audible signal that the operator can monitor. In addition, if desired, the voltage controlled amplifier can be provided with a tone or frequency control so that the operator can select a tone that is most pleasant to his hearing.

The system is operated in the same manner as a conventional coke cutting system except that the operator relies on the monitoring system instead of depending on his own bearing. The operator first drills the central opening and then reams it to a diameter substantially equal to the discharge opening of the coke drum. The operator then withdraws the hydraulic jets from the drum and changes to the jets used for cutting coke from the drum. As explained above, it is preferred to use jets that direct their hydraulic streams upward so that the cut surface of the coke has a sloping face. This assists in removing the cut coke and drawing the water from the coke shelf. The operator rotates the hydraulic nozzles until the amplitude of vibrations displayed by the monitoring system indicates that the jets are striking the walls of the coke drum. The operator then lowers the nozzles in the coke drum and cuts another layer of coke. This procedure is continued until all of the coke is cut from the coke drum.

It is obvious that modifications can be made in the present monitoring system as well as parts may be omitted. The use of both the graphic recorder and an audio system is, of course, unnecessary and only one of the two is necessary. Also, in place of the voltage controlled amplifier, one could select a particular frequency for the filter 22 and merely amplify the signal and reproduce it in a speaker. Also, of course, the signals from the monitoring system could be used to automate or semiautomate the coke cutting operation.

What is claimed is:

1. A method for assisting an operator in cutting coke in a coke drum comprising:

measuring the vibrations produced in the coke drum during a coke cutting operation;

filtering the measured vibrations to obtain the frequencies between 1000 and 2000 hertz;

displaying graphically said frequencies of interest; and forming an audio display of the amplitude of said frequencies whereby said operator can observe the graphic display and listen to the audio display during the coke cutting operation.

2. An apparatus for assisting an operator in cutting coke in a coke drum comprising:

vibration measuring means disposed to measure the vibration of the coke drum;

amplifier and filter means coupled to said vibration measuring means, said filter means being adapted to remove all frequencies outside the range of 1000 to 2000 hertz; graphic display means coupled to the amplifier and filter means for displaying the amplitude of the amplified and filtered signal; and an audio display coupled to the amplifier for producing an audible signal.

3. The apparatus of claim 2 wherein the audio display comprises a voltage controlled amplifier and a speaker.

* * * * *